United States Patent [19]

Jost

[11] 3,944,787

[45] Mar. 16, 1976

[54] HEATER ON METAL COMPOSITES

[75] Inventor: Ernest M. Jost, Plainville, Mass.

[73] Assignee: Texas Instruments Incorporated, Dallas, Tex.

[22] Filed: Dec. 26, 1973

[21] Appl. No.: 427,891

[52] U.S. Cl. ..... 219/543; 337/107; 338/328; 228/216

[51] Int. Cl.[2] ..... H05B 3/16; H01H 61/02; H01C/1/14

[58] Field of Search ..... 337/36, 53, 337/89, 102, 107, 77, 377; 338/307, 308, 309, 198, 205, 315, 328; 219/201, 443, 464, 468, 491, 494, 511, 543, 547, 549

[56] References Cited

UNITED STATES PATENTS

| | | | |
|---|---|---|---|
| 1,881,446 | 10/1932 | Flanzer | 219/543 |
| 2,624,823 | 1/1953 | Lytle | 219/543 X |
| 2,920,165 | 1/1960 | Dittman et al. | 337/107 |
| 3,248,501 | 4/1966 | Hire | 337/107 X |
| 3,370,262 | 2/1968 | Marty et al. | 338/328 X |
| 3,387,248 | 6/1968 | Rees | 219/543 X |
| 3,434,089 | 3/1969 | Waseleski, Jr. et al. | 337/107 |
| 3,649,945 | 3/1972 | Waits | 338/328 X |
| 3,791,863 | 2/1974 | Quirk | 219/543 X |
| 3,811,934 | 5/1974 | Glaser | 219/543 X |

FOREIGN PATENTS OR APPLICATIONS

| | | | |
|---|---|---|---|
| 1,077,283 | 7/1967 | United Kingdom | 337/107 |

*Primary Examiner*—Arthur T. Grimley
*Attorney, Agent, or Firm*—James P. McAndrews; John A. Haug; Russell E. Baumann

[57] ABSTRACT

A heater on metal composite unit. A strip of metal has a stripe of an electrically insulative and thermally conductive synthetic resin material bonded to one surface along the length thereof. At least one stripe of an electrically conductive material, having a width less than the width of the insulative stripe, is bonded to the surface of the insulative stripe along the length thereof. A strip of electrical resistance material at least partially overlies the stripes of both the conductive and insulative materials thereby providing a path of electrical resistance material from the conductive stripe transversely across a portion of the width of the insulative stripe whereby when electrical current flows through the electrical resistance material it will supply heat to the metal strip. Apparatus and a process for fabricating these composite units are also disclosed.

3 Claims, 9 Drawing Figures

HEATER ON METAL COMPOSITES

BACKGROUND OF THE INVENTION

This invention relates to heater on metal composite units and more particularly to composite strips and disks which may be continuously and economically fabricated and in which the heater is in close thermal contact with a metal substrate.

Electrically heated metal bodies have a wide variety of commercial and industrial uses, such as in thermostatic devices, thermal relays, time-delay relays, circuit breakers, etc. It is advantageous to have the electrically energized heater in good heat-exchange relation to the metal body, frequently a bimetal strip or disk, which changes its configuration as a function of temperature. Also, it is desirable to be able to supply such heater-metal units in various shapes and configurations at minimal expense.

SUMMARY OF THE INVENTION

Among the several objects of this invention may be noted the provision of heater on metal composite units in which the heater has a maximum of thermal contact with an underlying metal substrate; the provision of such composite units which can be conveniently fabricated in a wide variety of different shapes and configurations; and the provision of apparatus and processes for continuously, efficiently and economically fabricating such heater on metal composite units. Other objects and features will be in part apparent and in part pointed out hereinafter.

Briefly, the heater on metal composite units of this invention each comprise a strip of metal having a stripe of an electrically insulative and thermally conductive synthetic resin material bonded to one surface along the length thereof. At least one stripe of an electrically conductive material, having a width less than the width of the insulative stripe, is bonded to the surface of the insulative stripe along the length thereof. A strip of electrical resistance material at least partially overlies the stripes of both the conductive and insulative materials thereby providing a path of electrical resistance material from the conductive stripe transversely across a portion of the width of the insulative stripe whereby when electrical current flows through the electrical resistance material it will supply heat to the metal strip.

In accordance with the process of this invention, such heater on metal composite units are made by continuously applying a layer of a high temperature electrically insulating but thermally conductive synthetic resin material to one surface of a continuously moving metal strip and then applying at least one continuous stripe of an electrically conductive material lengthwise along one margin of the insulating layer. A second continuous electrically conductive stripe is provided along the length of the strip spaced from the first mentioned electrically conductive stripe. A layer of electrical resistance material is applied to the strip at intervals spaced along its length so as to at least partially overlie both conductive stripes and span and be bonded to the insulation layer therebetween. The thus-fabricated composite strip is then segmented into a plurality of heater on metal composite units of the desired shape and configuration.

Apparatus of this invention includes the structural components for automatically and continuously carrying out the above process.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
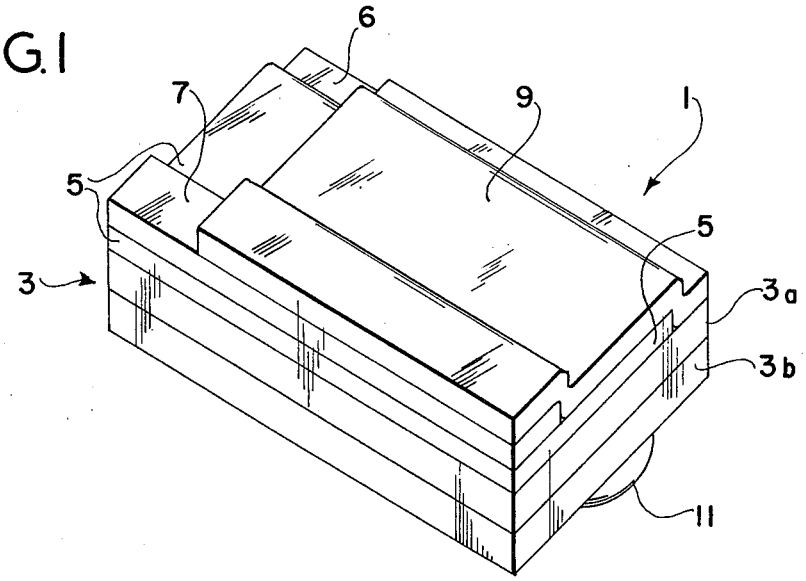
FIG. 1 is a perspective of a heater and bimetal strip composite of the present invention.

Referring now to the drawings, and more particularly to FIGS. 1–4, a heater on metal composite unit of this invention is generally indicated at 1. A metal strip 3 constituted, for example, by a bimetal strip with a layer **3*a* having one thermal coefficient of expansion and a second layer 3*b* bonded thereto and having a different thermal coefficient of expansion, comprises a substrate to which is bonded a stripe 5, constituted by a layer less than the width of strip 3, of an electrically insulative and thermal conductive material. This provides an exposed and uninsulated margin stripe 6 of the metal substrate layer 3*a*. Strip 1 may, for example, be a strip of bimetal in the order of 10 mils thick with a high expansion layer formed of a manganese-iron alloy, and a low expansion alloy formed of an iron-nickel alloy. Insulative stripe layer 5** may typically be about 1–1.5 mils thick and preferably formed from high temperature resin, i.e., one useful in temperature ranges in the order of 500°–600°F. An example of such a high temperature resin is a polyimide resin formed by heat curing a polyamic acid-solvent mixture, such as is obtainable under the trade designation "Pyre-M-L" from E. I. DuPont de Nemours and Company. Other high temperature resins such as benzophenones, polyamideimide, polybenzothiazoles, phosphonitrilic, etc., may also be used.

A stripe 7 of an electrically conductive material is bonded to stripe 5 along one margin thereof. This stripe is formed, for example, from a synthetic resin material, as is used for the insulating layer 5, mixed with conductive metal particles. A polyimide or amide modified polyimide resin having 17% by weight of silver flakes interspersed therein is useful for forming this conductive stripe. A stripe 7 of such material has a resistivity of about 0.10–0.12 ohms/square/mil. A conductive metal, such as copper, silver, tin, etc., may be advantageously electroplated on the surface of stripe 7, or applied by conventional evaporative techniques.

A strip 9 of electrical resistance material is bonded to conductive stripe 7, the exposed portion of insulative layer 5 and the exposed conductive margin stripe 6 of layer **3*a* of bimetal substrate 3. As layer 9 overlies and is in electrical contact with stripes 7 and 6 and spans the intervening surface portion of layer 5, this provides an electrical resistance path transversely across the width of the overlaid portion of insulating layer 5. Layer 5 is formed preferably of a mixture of a high temperature resin, such as noted above, but with particles of carbon, e.g., graphite (32% by weight), and a minor amount of silver or nickel powder interspersed therein. A typical mixture would have a resistivity on the order of 70 ohms/square. This material may be applied by silk screening or by applying preformed pressure-sensitive pads of such electrical resistance and is typically in the order of about 1 mil thick. Secured, by welding preferably, to the other surface of the heater on bimetal unit 1 is a conventional electrical contact button 11**.

Figure 2:
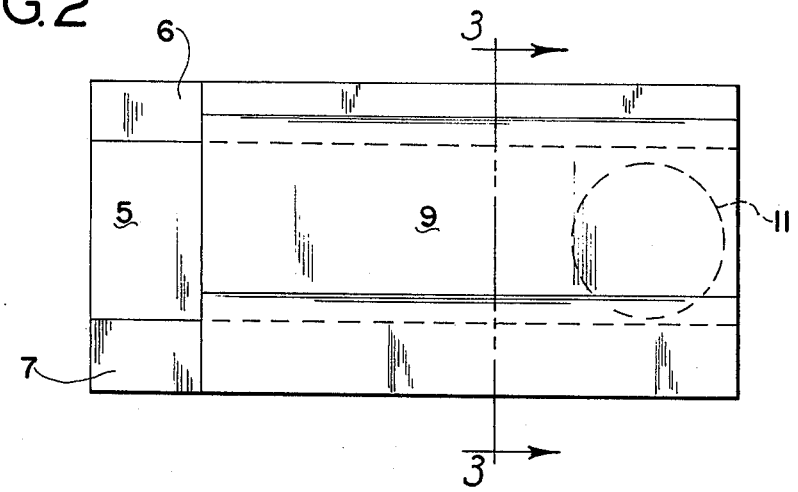
FIG. 2 is a plan view of the FIG. 1 composite.
Figure 3:
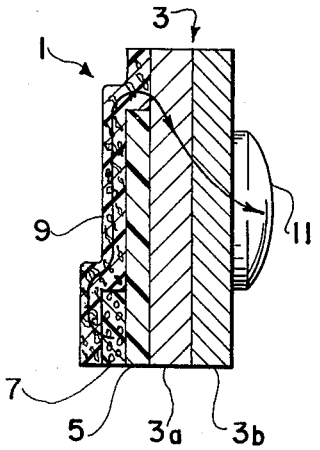
FIG. 3 is a cross section on line 3—3 of FIG. 2.
Figure 4:
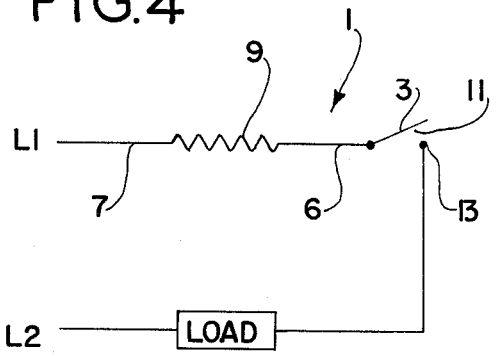
FIG. 4 is a circuit diagram of the composite of FIGS. 1–3 utilized as a low current circuit breaker for a low power electrical load.

FIG. 4 shows a low current circuit breaker utilizing heater on bimetal unit 1 to energize an electrical load from an electrical power source L1,L2, with L1 being electrically connected to the exposed portion of conductive stripe 7. The left end of unit 1 as viewed in FIGS. 1 and 2 is secured to a base (not shown) so that unit 1 is cantilever-mounted thereon with contact 11 positioned for mating engagement with a fixed contact 13 also secured to the base. With layer **3*b* the higher expansion bimetal layer and contacts 11 and 13 normally engaged, the heater layer 9 will heat to a temperature which is a function of the load current flow therethrough. At a temperature corresponding to a predetermined level of overload current the differential expansion of layers 3*a* and 3*b* will cause contact 11 to move away from contact 13 thereby breaking the circuit to the load and providing overload protection. The current flow through the electrical resistance layer 9 is indicated by arrows in FIG. 3. As insulation layer 5 has good thermal conductivity and is quite thin and major portion of electrical resistance layer 9 is in face-to-face contact therewith, there is excellent thermal contact and heat transfer between heater 9 and bimetal strip 3**.

Figure 5:
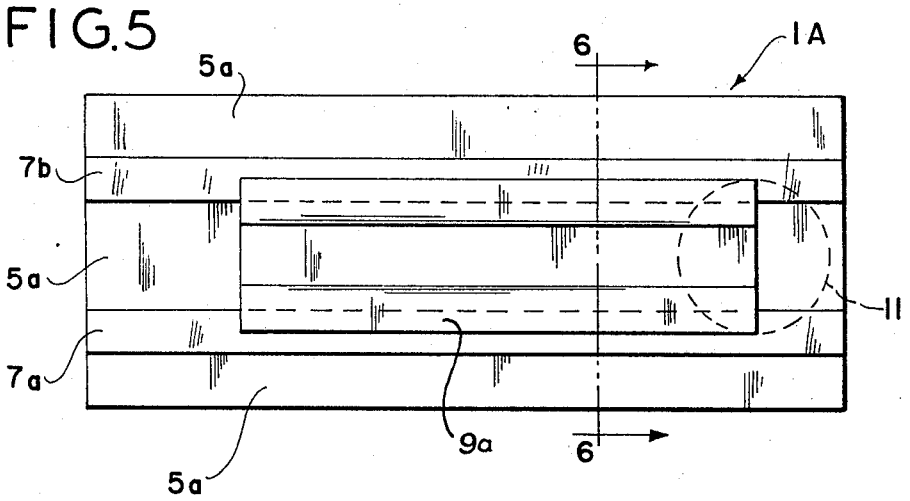
FIG. 5 is a plan of another heater and bimetal composite of the present invention.
Figure 6:
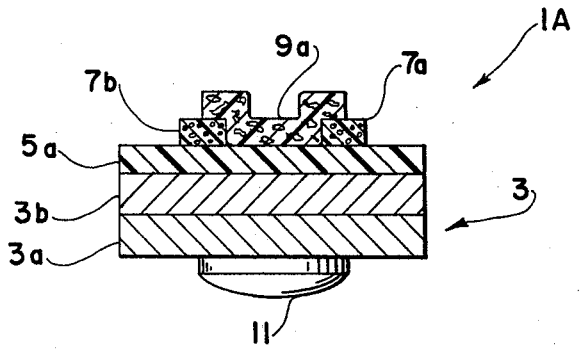
FIG. 6 is a cross section on line 6—6 of FIG. 5.
Figure 7:
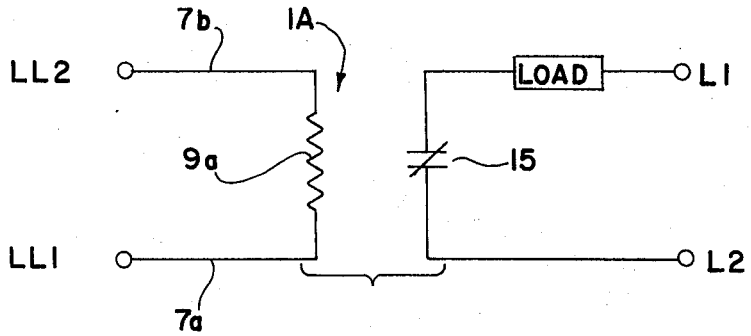
FIG. 7 is a schematic diagram of a thermal relay employing the bimetal composite of the present invention.

Another embodiment of this invention is shown in FIGS. 5–7 wherein a heater on bimetal composite unit 1A is shown to include a bimetal substrate 3 with an insulating layer **5*a* of high temperature synthetic resin bonded thereto across the entire width thereof. In this unit 1A a pair of spaced apart electrically conductive stripes 7*a* and 7*b* are applied to the surface of layer 5*a* and an electrical resistance layer 9a is bonded to stripes 7*a* and 7*b*. Layer 9*a* spans and is bonded to the intervening central portion of the insulating layer thus placing it in intimate thermal contact with bimetal strip 3 through the thin thermally conductive layer 5*a* interposed therebetween. The exposed areas of stripes 7*a* and 7*b* provide a convenient place to solder or otherwise secure conductors for electrical circuit connection to the electrical resistance layer 9*a***.

A thermal relay employing the heater on bimetal composite unit 1A is schematically shown in FIG. 7. In this instance the flow of heater current does not traverse, but is isolated from, the bimetal blade strip **3*a* and contact 11. Upon sufficient current flow from a low current power source LL1 and LL2 through electrical resistance layer 9*a*, it will heat strip 3*a* to change its curvature to open normally closed contacts 15** thereby breaking the circuit to the load between lines L1,L2.

Figure 8:
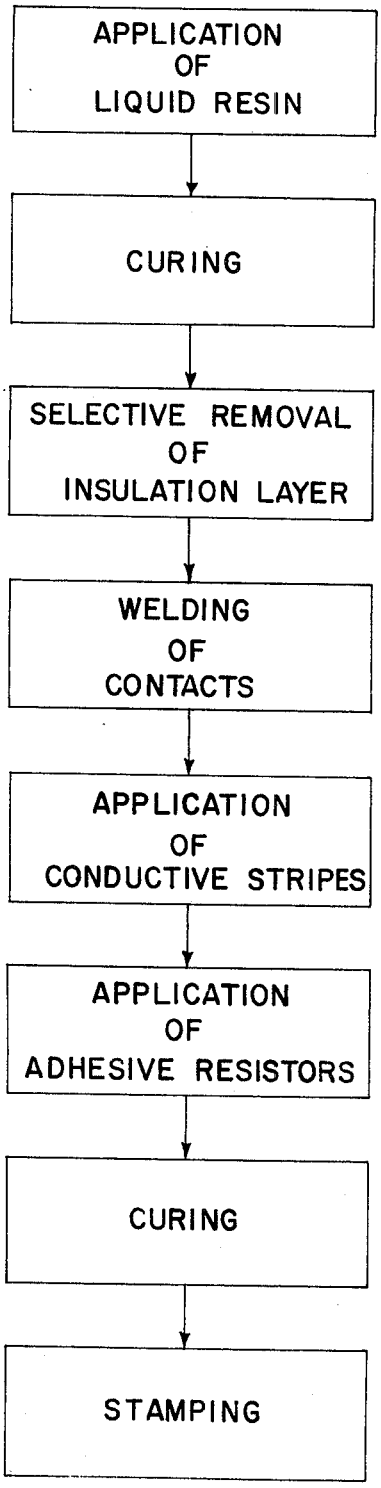
FIG. 8 is a block diagram illustrating the steps of a process of the present invention for continuously fabricating heater and bimetal strip composites thereof.
Figure 9:
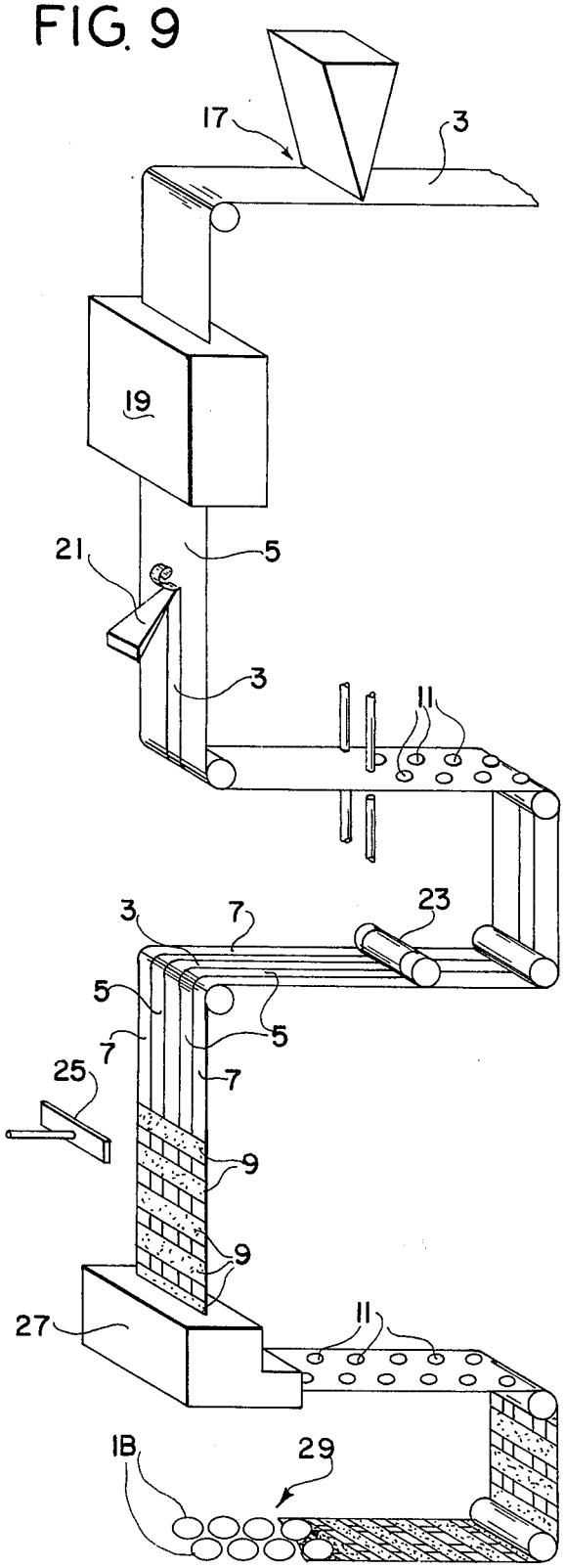
FIG. 9 is a diagrammatic view of apparatus of the present invention for carrying out the process illustrated in FIG. 8.

Apparatus and a process of this invention are illustrated in FIGS. 8 and 9. A continuous web of strip 3 of a metal or a bimetal to serve as a substrate for the units of this invention has a thin coating of liquid resin material applied to its upper surface as indicated at 17. Strip 3 with this coating is then moved through a curing oven 19 where the resin is cured to form the high temperature resin insulation layer 5, a central lengthwise portion 21 thereof being selectively removed by stripping to form or provide a central conductive stripe of exposed substrate 3. Electrical contact buttons 11 are then welded to the other surface of strip 3 at intervals spaced along its length. Thereafter a pair of electrically conductive stripes 7 are applied by roller applicator 23 to the margins of insulating layer 5. A reciprocal applicator 25 then applies at intervals along the length of the moving strip performed pads of pressure-sensitive electrical resistance layers 9 which are cured and bonded to the exposed surfaces of conductive stripes 7 and 3. The resulting continuous composite strip is then segmented into a plurality of heater on bimetal composite units 1C by stamping as indicated at 29. These are shown as thermostatic dish-shaped bimetallic disks 1B adapted for connection to electrical circuit leads and mounting as a subassembly in a thermal relay, low power circuit breaker or the like.

It will be understood that units 1B and 1 may be similarly automatically, continuously and economically fabricated and that customary silk screening techniques may be utilized to apply insulating layers 9 rather than using performed pressure sensitive pads of electrical insulation material 9.

In view of the above, it will be seen that the several objects of the invention are achieved and other advantageous results attained.

As various changes could be made in the above methods, constructions, and products without departing from the scope of the invention it is intended that all matter contained in the above description or shown in the accompanying drawings shall be interpreted as illustrative and not in a limiting sense.

What is claimed is:

1. A heater unit comprising:

a strip of electrically conductive metal material;

a stripe of an electrically insulative synthetic resin material bonded to a selected limited part of one surface of the metal strip extending along the length of the metal strip exposing a marginal part of said one strip surface also extending along the length of the metal strip;

a stripe of an electrically conductive material bonded to a selected limited part of one surface of the insulative stripe along the length of the insulative stripe exposing a marginal part of said insulative stripe also extending along the length of the insulative stripe adjacent to said exposed marginal part of said one metal strip surface; and a strip of electrical resistance material overlying and being bonded to a selected part of the electrically conductive stripe, of the exposed marginal part of said insulative stripe, and of the exposed marginal part of said metal strip providing a path of selected electrical resistance between the conductive stripe and said metal strip, whereby, when electrical current flows through said electrical resistance material, heat will be supplied to said metal strip.

2. A composite unit as set forth in claim 1 wherein the metal strip is itself a composite of two metal layers having different thermal coefficients of expansion whereby the strip has a curvature which is a function of the temperature thereof and wherein said electrical resistance heater comprises an organic resin having a conductive particulate filler therein permitting curvature of the metal strip as a function of the temperature thereof.

3. A composite unit as set forth in claim 2 in which said conductive stripe comprises a mixture of conductive metal particles and a synthetic resin material.

* * * * *